United States Patent [19]

Shaw

[11] Patent Number: 5,001,981

[45] Date of Patent: Mar. 26, 1991

[54] SIGNAL TRANSMISSION TUBE FOR INITIATION OF EXPLOSIVES

[75] Inventor: Lester W. Shaw, Avon, Conn.

[73] Assignee: The Ensign-Bickford Company, Simsbury, Conn.

[21] Appl. No.: 509,086

[22] Filed: Apr. 16, 1990

[51] Int. Cl.[5] ..... F42C 19/00; C06C 5/04

[52] U.S. Cl. ..... 102/275.8; 102/275.1; 102/275.3

[58] Field of Search ..... 102/275.1, 275.7, 275.8, 102/275.9

[56] References Cited

U.S. PATENT DOCUMENTS

| | | | |
|---|---|---|---|
| 927,968 | 7/1909 | Harlé | 102/275.1 |
| 2,877,708 | 3/1959 | Rey | 102/275.3 |
| 3,389,659 | 6/1968 | Cassidy et al. | 102/275.1 |
| 3,590,739 | 7/1971 | Persson | 102/275.8 |
| 3,712,222 | 1/1973 | Richardson et al. | 102/275.1 |
| 3,945,320 | 3/1976 | Gibson et al. | 102/275.1 |
| 4,455,941 | 6/1984 | Walker et al. | 102/275.8 |
| 4,917,017 | 4/1990 | Beltz | 102/275.1 |

*Primary Examiner*—David H. Brown

*Attorney, Agent, or Firm*—Doanld J. Hayes; R. William Reinsmith

[57] ABSTRACT

A plurality of discrete transmission tubes are held in axially extending juxtaposed relation by an outer sheath which coextensively covers the tubes. An axially extending line of weakness is formed along the length of the sheath. The transmission tubes may be simultaneously initiated for redundent transmission of an initiation signal.

11 Claims, 2 Drawing Sheets

SIGNAL TRANSMISSION TUBE FOR INITIATION OF EXPLOSIVES

TECHNICAL FIELD

This invention relates to transmission of initiation signals for explosives and the like, and more particularly to redundant signal transmission by a plurality of signal transmission tubes.

BACKGROUND OF THE INVENTION

In detonating a plurality of blasting charges, transmission tubes may be deployed from a central initiating point to transmit initiation signals to detonate individual blasting charges. Although transmission tubes have been traditionally and primarily used for blasting initiation, there are a number of other uses for transmission tubes. For example, transmission tubes have been used to transmit an automobile collision impact signal to activate automatic inflation of an automobile protective air bag, or automatic pre-tensioning of automobile driver and passenger safety belts.

The aforementioned transmission tubes may be of the type disclosed in U.S. Pat. No. 3,590,739, sold under the trademark "Nonel", and sometimes referred to as "shock tube". As used herein, the term "transmission tube " refers to any detonating or deflagrating signal transmission tube or line including a flexible hollow tube, which can carry a detonating or deflagrating signal along its interior, which signal does not destroy the tube.

The term "signal" when used in connection with the aforementioned transmission tube is intended to refer to either the detonating shock wave or deflagrating flame front which is transmitted along the interior of the tube by combustion of a reactive substance contained therein.

In detonating a charge, or in activating an automobile safety feature, it is extremely important that the device used to transmit the signal to initiate these functions be reliable. However, in field use for blasting initiation, and also in heavy manufacturing environments, the reliability of transmission tubes may be inadvertently reduced. For example, if the environment seal of a transmission tube is breached, environmental contamination may be introduced into the transmission tube interior, thereby reducing the reliability of signal transmission.

It is therefore an object of the invention to provide a signal transmission device having improved reliability of signal transmission.

It is another object of the invention to provide a reliable signal transmission device having improved durability and impermeability to fluids.

It is a further object of the invention to provide a reliable signal transmission device, capable of transmitting a plurality of signals, that is easy to handle and deploy.

It is another object of the invention to provide an opaque signal transmission device which conceals a signal it is transmitting.

It is a further object of the invention to provide a reliable signal transmission device that is easy to manufacture and facile in its use.

It is another object of the invention to provide a reliable signal transmission device the continuity of which can be easily tested between the point of signal initiation and the destination point of the signal.

Other objects will be in part obvious and in part pointed out in more detail hereinafter.

A better understanding of the objects, advantages, features, properties and relations of the invention will be obtained from the following description and accompanying drawings which set forth certain illustrative embodiments and are indicative of the various ways in which the principles of the invention are employed.

SUMMARY OF THE INVENTION

A redundant signal transmission tube constructed according to the present invention comprises, in its preferred embodiment, a plurality of signal transmission tubes bundled together in axially extending juxtaposed relation for substantially the entire length of the tubes between a first end of the tubes and a second end of the tubes; the bundle of tubes being encased within an outer sheath coextensively covering the plurality of tubes between the first end and the second end.

In further accord with the invention, the outer sheath provides a durable, environmentally impermeable covering over the transmission tubes which cooperates with the tubes to maintain them in juxtaposed relation, the outer sheath further having an axially extending line of weakness for its entire length, the line of weakness being of lower tensile strength than the remainder of the sheath for allowing easy removal of the sheath by separating the sheath along the line of weakness.

In still further accord with the invention, a plurality of conductors for conducting a signal, such as fiber optic cable for conducting a light signal or copper wire for conducting an electric signal, are provided between the first and second ends of the bundle of transmission tubes for testing the continuity between the first and second ends of the bundle.

DETAILED DESCRIPTION OF CERTAIN PREFERRED EMBODIMENTS

The present invention comprises an apparatus for redundantly transmitting a signal, such as a blasting initiation signal, using a plurality of signal transmission tubes. With the present invention, it is possible to deploy the plurality of transmission tubes as a single line between an initiation point and the destination point of the signal. The present invention is particularly well suited for use in the initiation of blasting charges such as those used in quarry blasting, however, other applications, such as the initiation of explosive charges used by the military, or the activation of safety devices used in automobiles, will become obvious as the reader gains a complete understanding of the ways in which the invention functions.

Referring in detail to the drawings, a redundant signal transmission device of the present invention is generally indicated by numeral 10, and comprises a pair of transmission tubes 11 within a protective sheath 12.

Figure 1:
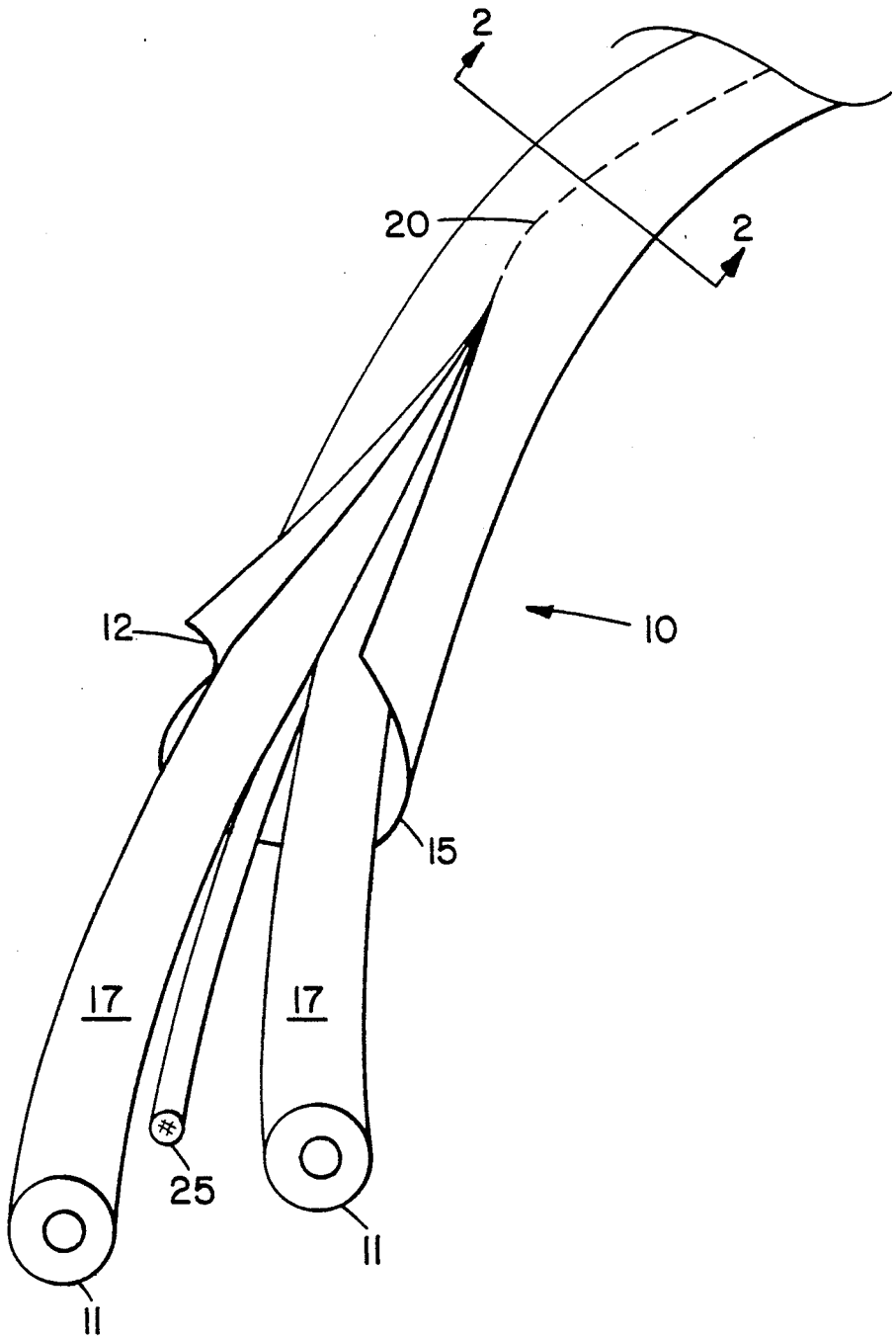
FIG. 1 is a perspective view of a redundant signal transmission device of the present invention, a portion of the outer sheath being separated along a line of weakness.
Figure 2:
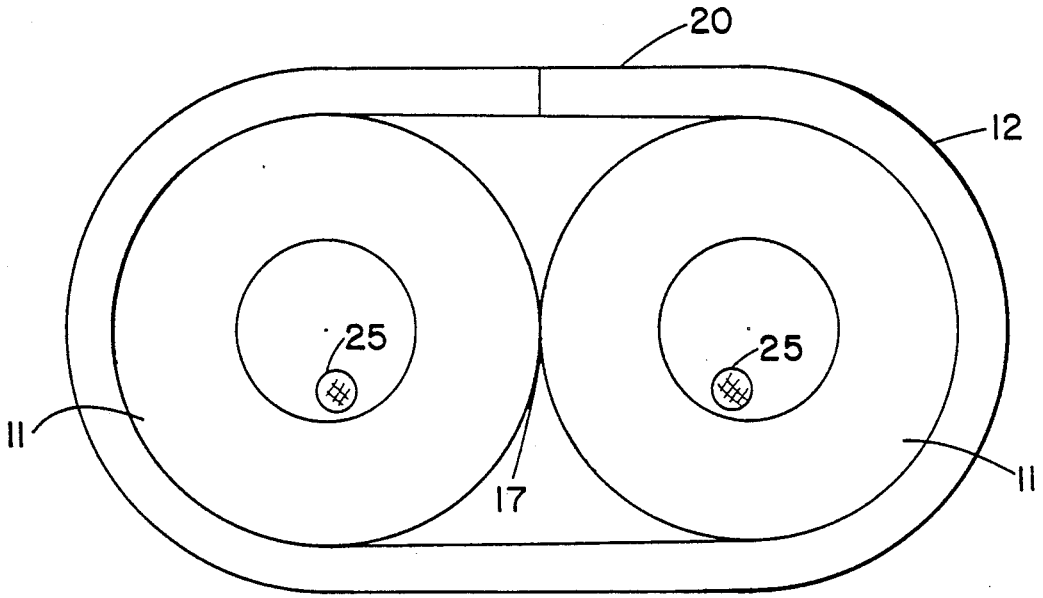
FIG. 2 is a cross sectional view of an alternative embodiment of the device taken along line 2—2 of FIG. 1.

Referring to FIGS. 1 and 2, the transmission tube 11 may be any detonating or deflagrating signal transmission tube or line including a flexible hollow tube, which can carry a detonating or deflagrating signal along its interior, which signal does not destroy the tube. The tubes 11 are in axially extending juxtaposed relation for substantially their entire length between a first end of the tubes 15 and a second end of the tubes (not shown), an outer surface 17 of each of the tubes may be in axially extending contact between the first and second ends of the tubes, however the tubes may be in closely spaced parallel relation over a substantial portion of their length.

The sheath of the present invention is well suited for protecting the tubes from mechanical damage and environmental contamination, and maintains the tubes in axially extending juxtaposed relation between the tube first and second ends. More particularly, as illustrated in FIGS. 1 and 2, the sheath 12 is generally elliptical in shape, coextensively covering the tubes 11 between the first and second ends of the tubes. The sheath 12 is manufactured of a high strength, environmentally impermeable, and flexible material suitable to withstand external damage and mechanical stress. Suitable materials for the sheath are poly-olefins, including, but not limited to linear low density polyethylene, linear medium density polyethylene, low density polyethylene, blends of linear low density polyethylene with ionomer, polypropylene, polybutylene, nylon, and blends of nylon with co-extrudible adhesives.

Figure 3:
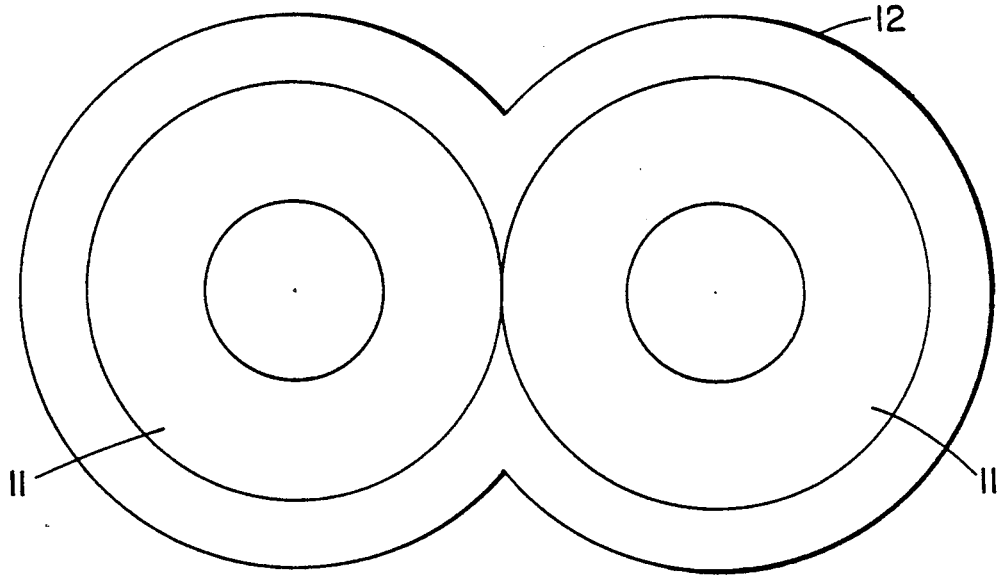
FIG. 3 is a cross sectional view of an alternative embodiment of the redundant signal transmission device of FIG. 1.

FIG. 2 illustrates that the sheath 12 of the present invention is manufactured to provide a tight covering for the tubes 11 that is in contact with the tubes but that does not adhere to the tubes. Although the tubes 11 and the sheath 12 are not directly attached, the tight fit of the tubes within the sheath generates sufficient friction therebetween to prevent the tubes from freely moving within the sheath or slipping out of the sheath; however, there is sufficient play in the fit of the tubes within the sheath to allow easy deployment of the assembly. In an alternative embodiment of the invention, illustrated in FIG. 3, the sheath 12 is manufactured to adhere directly to the tubes 11 contained therein.

Referring again to FIGS. 1 and 2, the sheath 12 may be manufactured with a line of weakness 20 axially extending along the length of the sheath. The line of weakness 20 comprises an area of lower tensile strength than the remainder of the sheath 12, and therefor an area that can be parted by applying sufficient force on the sheath. The line of weakness 20 is formed during the manufacturing process by parting the sheath during a sheath extrusion process, and allowing the sheath to be rejoined along the part before the sheath material cures, thereby forming a lower strength bond than the remainder of the extruded sheath. The line of weakness allows the sheath to be removed near the ends of the tubes so that individual transmission tubes may be deployed to distinct signal initiators and signal destinations.

For further improvement in the reliability of signal initiation, the redundant signal transmission device of the present invention is provided with a plurality of conductors for performing a continuity test of the device after it has been deployed between a signal initiation point and the signal destination. More particularly, one or more conductors 25 for conducting a continuity signal, e.g., fiber optic cables for conducting a light signal or metal wires for conducting an electronic signal, are enclosed within the the sheath as illustrated in FIG. 1, or are enclosed within the transmission tubes as illustrated in FIG. 2. A single conductor may be used along the length of the tubes, as illustrated in FIG. 1, and a continuity signal may be transmitted into one end of the conductor and sensed at the other end of the conductor. However, it may be desirable to use two conductors deployed along the length of the tubes and joined at one end of the conductors, or a single conductor looped along the length of the tubes, so that a continuity test signal can be transmitted and sensed at the same end of the tubes. The results of a continuity test may be used to give an indication as to whether the integrity of the signal transmission tubes has been breached.

The operation of the invention is best understood by example. A length of redundant signal transmission tube is disposed between an initiation point and a signal destination point. After the length of tube is run, a continuity check may be performed at any time to determine if the device has been parted at any point between the initiation point and the destination point. If the results of the continuity check are satisfactory, the transmission tubes within the sheath may preferably be used to interconnect a single initiation device with a corresponding signal destination. This configuration provides for simultaneous initiation of the tubes for redundant signal transmission, and therefor provides for improved reliability of signal transmission.

Another feature of the present invention is that a portion of the sheath may be removed at either end of the tubes to allow the tubes to branch out so that one end of each of the individual tubes may be connected to an initiation device at the initiation point for initiating a signal in the tubes, and the other end of each tube may be connected to a corresponding location for receipt of the signal transmitted by the tube. The individual tubes within a sheath may be color coded or have other distinctive markings to ensure that the corresponding signal initiation device and signal destination point are properly connected by a transmission tube.

For certain applications of transmission tube, such as military use, it may be desirable to covertly transmit a signal. This may be accomplished by impregnating the outer sheath with opaque material that does not permit viewing of the combustion reaction occurring within the transmission tubes during signal propagation.

Although the invention is described as being used with only two tubes within the sheath, any number of tubes may be contained within a single sheath without departing from the spirit and scope of the present invention. Additionally, the line of weakness is describes as being formed by parting the sheath during the sheath extrusion process; however, the invention would work equally as well with any method of forming an axially extending region of low tensile strength on the sheath, such as extruding the sheath with a region of reduced material thickness.

Although the invention has been illustrated and described with respect to exemplary embodiments thereof, it should be understood by those skilled in the art that the foregoing and various other changes, omissions and additions may be made therein and thereto, without departing from the spirit and scope of the invention.

I claim:

1. Apparatus for redundant transmission of a signal, comprising:

a plurality of discrete transmission tubes, said tubes being in axially extending juxtaposed relation between a first end of said tubes and a second end of said tubes; and an outer sheath 12 coextensively covering said plurality of transmission tubes between said first end and said second end, said sheath cooperating with said tubes to maintain said tubes in juxtaposed relation between said first end and said second end, said sheath 12 further being durable, environmentally impermeable, and resistant to external damage from mechanical stress.

2. Apparatus according to claim 1 wherein said plurality of transmission tubes are arranged with an outer surface of each of said tubes in axially extending contact with an outer surface of other of said tubes between said first end and said second end, each tube being in axially extending contact with at least one other tube.

3. Apparatus according to claim 1 wherein said plurality of transmission tubes are in closely spaced parallel relation over substantially the entire length of the tubes.

4. Apparatus according to claim 1 further comprising a line of weakness axially extending along the length of said sheath, said line of weakness being of lower tensile strength than the remainder of said sheath for allowing said sheath to be easily parted along said line of weakness thereby facilitating the connection of individual tubes within said sheath between corresponding initiators and use devices.

5. Apparatus according to claim 1 wherein each tube of said plurality of transmission tubes is provided with unique, distinctive markings.

6. Apparatus according to claim 1 wherein said sheath is opaque for covert transmission of a signal by said tubes contained therein.

7. Apparatus according to claim 1 further comprising means for conducting a continuity signal along the length of said tubes.

8. Apparatus according to claim 7 wherein said means for conducting comprises a fiber optic cable for conducting a light signal.

9. Apparatus according to claim 7 wherein said means for conducting comprises a metallic wire for conducting an electric signal.

10. Apparatus particularly useful for simultaneous initiation of a plurality of signal transmission tubes wherein said tubes are in axially extending juxtaposed relation between both ends of said tubes, comprising:

an outer sheath coextensively covering said plurality of transmission tubes between said tube ends, said sheath cooperating with said tubes to maintain said tubes in juxtaposed relation; and a line of weakness axially extending along the length of said sheath, said line of weakness being of lower tensile strength than the remainder of said sheath for allowing said sheath to be easily parted along said line of weakness.

11. Apparatus for transmission of a plurality of signals, comprising:

a plurality of discrete transmission tubes, said tubes being in axially extending juxtaposed relation over a substantial length of the tubes; and an outer sheath coextensively covering said plurality of transmission tubes over said substantial length of the tubes, said sheath cooperating with said tubes to maintain said tubes in juxtaposed relation between first and second ends of said sheath, each tube extending outwardly from the first and second ends of said sheath for positioning in spaced relation to one another, thereby facilitating the connection of each of said tubes between a corresponding initiator and used device.

* * * * *